US011011854B2

(12) United States Patent
Haziza et al.

(10) Patent No.: US 11,011,854 B2
(45) Date of Patent: May 18, 2021

(54) POLYMER DISPERSED/SHEAR ALIGNED PHASE MODULATOR DEVICE

(71) Applicant: Wafer LLC, Hanover, NH (US)

(72) Inventors: Dedi David Haziza, Kiryat Motzkin (IL); Eliyahu Harush, Mizpe Aviv (IL)

(73) Assignees: WAFER LLC, Hannover, NH (US); SDEROTECH, INC., Wilmington, DE (US)

( * ) Notice: Subject to any disclaimer, the term of this patent is extended or adjusted under 35 U.S.C. 154(b) by 211 days.

(21) Appl. No.: 16/166,009

(22) Filed: Oct. 19, 2018

(65) Prior Publication Data

US 2019/0123454 A1 Apr. 25, 2019

Related U.S. Application Data

(60) Provisional application No. 62/574,680, filed on Oct. 19, 2017.

(51) Int. Cl.

| | |
|---|---|
| ***H01Q 21/06*** | (2006.01) |
| ***H01Q 3/36*** | (2006.01) |
| ***H01Q 1/48*** | (2006.01) |
| ***H01Q 1/38*** | (2006.01) |
| ***H01Q 9/04*** | (2006.01) |

(52) U.S. Cl.

CPC ..... *H01Q 21/065* (2013.01); *H01Q 1/38* (2013.01); *H01Q 1/48* (2013.01); *H01Q 3/36* (2013.01); *H01Q 9/0407* (2013.01); *H01Q 9/0442* (2013.01); *H01Q 9/0457* (2013.01)

(58) Field of Classification Search

CPC ..... H01Q 21/065

See application file for complete search history.

(56) References Cited

U.S. PATENT DOCUMENTS

| | | | | |
|---|---|---|---|---|
| 4,937,585 | A * | 6/1990 | Shoemaker | H01Q 3/36 343/700 MS |
| 6,335,699 | B1 | 1/2002 | Honma | |
| 10,177,453 | B2 * | 1/2019 | Haziza | H01Q 1/48 |
| 10,320,070 | B2 * | 6/2019 | Haziza | H01Q 1/38 |
| 10,505,280 | B2 * | 12/2019 | Haziza | H01Q 21/245 |

(Continued)

FOREIGN PATENT DOCUMENTS

| | | | |
|---|---|---|---|
| JP | 2000-236207 | A | 8/2000 |
| JP | 2000-315902 | A | 11/2000 |

(Continued)

OTHER PUBLICATIONS

Transmittal of International Preliminary Report on Patentability for PCT/US2018/056792, filed Oct. 19, 2018, dated Apr. 21, 2020, 8 pages.

(Continued)

*Primary Examiner* — Ab Salam Alkassim, Jr.

(74) *Attorney, Agent, or Firm* — Womble Bond Dickinson (US) LLP; Joseph Bach, Esq.

(57) ABSTRACT

An antenna comprising: a variable dielectric constant (VDC) layer; a plurality of radiating patches provided over the VDC layer; a plurality of signal lines, each terminating in alignment below one of the radiating patches; a plurality of control lines, each corresponding to one of the signal lines; a ground plane; wherein the VDC layer comprises: a polymer dispersed liquid crystal (PDLC) layer or a PDLC layer in a polymerized and sheared state.

20 Claims, 5 Drawing Sheets

(56) References Cited

U.S. PATENT DOCUMENTS 10,511,096 B2 * 12/2019 Haziza ..... H01P 5/227
10,658,755 B2 * 5/2020 Hashimoto ..... H01Q 9/0457
10,700,426 B2 * 6/2020 Haziza ..... H01Q 21/065
10,705,391 B2 * 7/2020 Haziza ..... G09G 3/36
10,741,921 B2 * 8/2020 Haziza ..... H04B 7/0413
10,862,219 B2 * 12/2020 Haziza ..... H01Q 21/0006
2004/0164907 A1 * 8/2004 Killen ..... H01Q 9/0457 343/700 MS
2008/0036664 A1 * 2/2008 Haziza ..... H01Q 9/0442 343/700 MS
2009/0091500 A1 * 4/2009 Haziza ..... H01Q 9/0442 343/700 MS
2009/0278744 A1 11/2009 Kirino et al.
2010/0060535 A1 * 3/2010 Tiezzi ..... H01Q 5/40 343/770
2014/0266897 A1 * 9/2014 Jakoby ..... H01Q 1/38 342/368
2015/0109178 A1 * 4/2015 Hyde ..... H01Q 5/0006 343/772
2016/0187700 A1 * 6/2016 Engel ..... G02F 1/1303 349/182
2016/0197406 A1 * 7/2016 Hashimoto ..... H01Q 9/0457 343/848
2016/0204509 A1 * 7/2016 Zhai ..... H01Q 5/40 343/725
2016/0241217 A1 * 8/2016 Sazegar ..... H01Q 3/44
2017/0218686 A1 * 8/2017 Galstian ..... G02F 1/133345
2017/0301475 A1 * 10/2017 Stevenson ..... H01Q 9/0457
2018/0062266 A1 * 3/2018 Haziza ..... H04L 27/18
2018/0062268 A1 * 3/2018 Haziza ..... H01Q 21/245
2018/0062272 A1 * 3/2018 Haziza ..... H01Q 9/0407
2018/0159213 A1 * 6/2018 Haziza ..... H01Q 21/065
2018/0159239 A1 * 6/2018 Wyler ..... H01Q 9/0435
2019/0044234 A1 * 2/2019 Isom ..... H01Q 21/0006
2019/0064609 A1 * 2/2019 Haziza ..... H01Q 1/44
2019/0131719 A1 * 5/2019 Haziza ..... H01Q 21/0037
2019/0296440 A1 * 9/2019 Haziza ..... H04B 7/0413
2019/0341693 A1 * 11/2019 Haziza ..... H01P 1/181
2020/0044338 A1 * 2/2020 Haziza ..... H01Q 1/288
2020/0067186 A1 * 2/2020 Reynolds ..... B60L 53/10
2020/0067187 A1 * 2/2020 Reynolds ..... H01Q 21/065
2020/0112102 A1 * 4/2020 Haziza ..... H01Q 21/065
2020/0381824 A1 * 12/2020 Kao ..... H01Q 1/48

FOREIGN PATENT DOCUMENTS

JP 2003-017912 A 1/2003
JP 2004-023228 A 1/2004

OTHER PUBLICATIONS

Transmittal of the International Search Report and Written Opinion of the International Searching Authority for PCT/PCT/US2018/056792, filed Oct. 19, 2018, dated Feb. 26, 2019, 9 pages.
Kretzer, M. (2016). "Polymer Dispersed Liquid Crystals-Materiability". Digital Crafting, HBK Braunschweig, 4 pages.
Dolfi, D., et al., "Liquid Crystal Microwave Phase Shifter," Electronics Letters, vol. 29, No. 10, May 13, 1993.

* cited by examiner

POLYMER DISPERSED/SHEAR ALIGNED PHASE MODULATOR DEVICE

CROSS-REFERENCE TO RELATED APPLICATIONS

This application claims priority from U.S. Provisional Application No. 62/574,680, filed Oct. 19, 2017, the disclosure of which is incorporated herein by reference in its entirety.

BACKGROUND

1. Field

This disclosure relates generally to liquid crystal phase modulators and antenna devices and, more specifically, to the use of polymer dispersed liquid crystal, shear aligned polymer dispersed liquid crystal, and stacked liquid crystal layers to control electrical property of an RF device, such as an antenna.

2. Related Art

In recent years, wireless communication systems related applications are increasing in different fields. Future applications require the use of antenna with a multiband and wideband capabilities. Phase modulators, and in particular antennas, should have low profile, light weight, low cost and ease of integration with microwave devices, etc. Unlike current antenna design, which includes a large mechanical rotating dish, in order to incorporate antennas in next generation telecommunication hardware a small size antenna with omni-directional radiation pattern, wide bandwidth and stable gain is preferred. The use of variable dielectric constant materials, specifically liquid crystal (LC) has been proposed in previous work. Such antenna generates a scanning RF beam according to the applied electrical field force and direction, which can be controlled by software. In this manner a focal plane scanning antenna, or a phase shifter in general, is able to maintain its low profile and size, without the use of mechanically moving parts. See, e.g., U.S. Pat. No. 7,466,269; US 2014/0266897; US 2018/0062268; and US 2018/0062238.

For applications where the wavelength of the operating device is in the microwave range, the required active layer thickness, i.e., the thickness of the variable dielectric material (such as liquid crystal), is required to be quite high, 50-200 μm, 200-500 μm, 1000 μm and even up to several millimeters. In addition, the response times of the antenna/phase shifter device, (τon, τoff), need to be adequate to support packet-based beam forming. Various applications, such as a scanning focal plane array antenna which is tracking a fast-moving target, or required to monitor several moving q stationary targets at the same time, the response times should be reduced even further, e.g., to 1 μs or lower. However, the increase in the active layer thickness results in an increase in the response times of the system. In a phase shifter/antenna device based on nematic liquid crystal materials, or oven ferroelectrics, the response times are correlated to the active layer thickness (r) by a general equation: $\tau_{on} \propto r^2$, which means that a device operating with a very thick active layer cannot reach ultra-fast response times, per system requirement.

Polymer Dispersed Liquid Crystal (PDLC) material has been developed for optical devices to modulate light passing through the PDLC material, See, e.g., U.S. Pat. No. 8,054, 413. PDLC is composed of a polymer matrix enclosure containing liquid crystal domains, and has several advantages over standard liquid crystal technology. In particular, PDLC does not require the use of an alignment layer on the two substrates, since alignment of the liquid crystal directors is achieved on the matrix material surrounding the liquid crystal domains. Because of that, thicker active layer is achievable, as described in the literature. In an improvement to the PDLC, SLC (Stressed Liquid Crystal) material has been suggested, whereby in effect a PDLC is produced and is sheared in a manner that creates ellipsoid shape liquid crystal domains. By shearing the polymer, the liquid crystal domains are elongated in the shearing direction and as they are drawn, they are aligned. In this way, the liquid crystal directors in the SLC are virtually all aligned. This method is able to achieve a thick active layer, where all the liquid crystal domains are aligned without the need for an alignment layer.

SUMMARY

The following summary of the disclosure is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

Disclosed aspects of the present invention provide an RF device, e.g., antenna or a phase shifter, comprising a PDLC or SLC layer and a method for manufacturing such a device. The result is the ability to achieve the highest delta ε ($\Delta\varepsilon=\varepsilon_{|}-\varepsilon\perp$) which the liquid crystal is capable of. Also, rise and fall times are much improved over corresponding LC device. In certain embodiments, the SLC creates homogenous alignment of the liquid crystal directors inside the PDLC/SLC material.

According to further aspects, a method is provided for producing alignment in liquid crystal domains within a PDLC matrix, by inducing a shearing force on the polymeric matrix. By controlling the temperature, relative concentrations of LC and polymer, polymerization process and shear speed, length and duration during or after polymerization, the size and distribution of the LC domains is affected and the LC alignment is achieved without the use of a surface alignment layer.

Another aspect is to provide the method for making the PDLC or SLC layer, in or outside the RF device, comprising: pre-polymerization solution mix, polymerization processes suitable to incur a phase separation between the polymer (cured) and the liquid crystal phase (un-curable), and a method of applying shear force on the PDLC layer in order to produce a SLC layer, wherein the liquid crystal domains are elongated in the shear direction, and the liquid crystal directors are aligned in the same shear direction.

In its generic aspect, an antenna is provided which comprises: a variable dielectric constant (VDC) layer; a plurality of radiating patches provided over the VDC layer; a plurality of signal lines, each terminating in alignment below one of the radiating patches; a plurality of control lines, each corresponding to one of the signal lines; a ground plane; wherein the VDC layer comprises: a polymer dispersed liquid crystal (PDLC) layer. In a further embodiment, the PDLC layer is in a polymerized and sheared state.

BRIEF DESCRIPTION OF THE DRAWINGS

Other aspects and features of the invention would be apparent from the detailed description, which is made with reference to the following drawings. It should be appreciated that the detailed description and the drawings provides various non-limiting examples of various embodiments of the invention, which is defined by the appended claims.

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

Plot 1 illustrates rise and fall rates of an LC layer and a corresponding PDLC layer.

Figure 1:
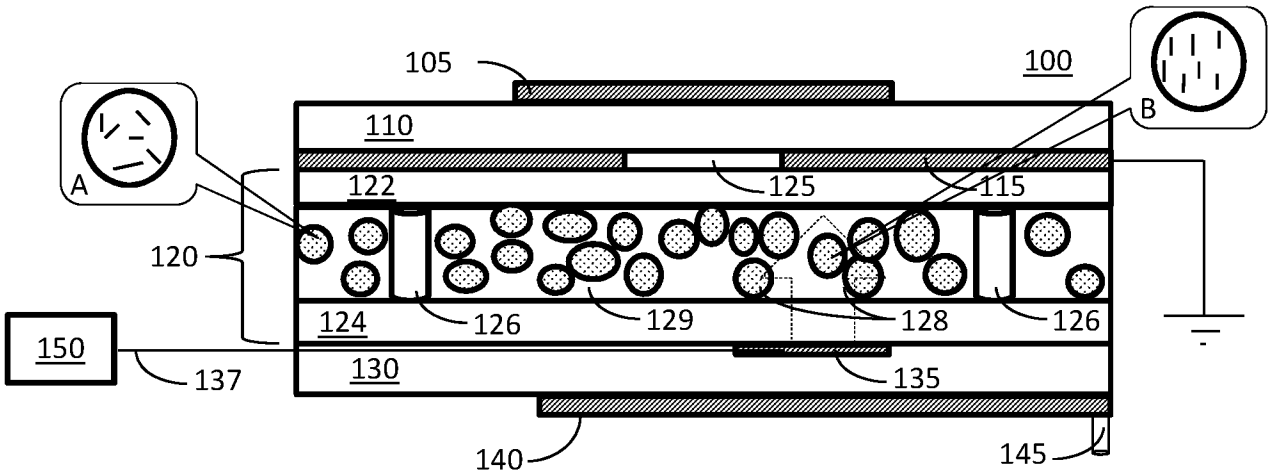
Figure 1A:
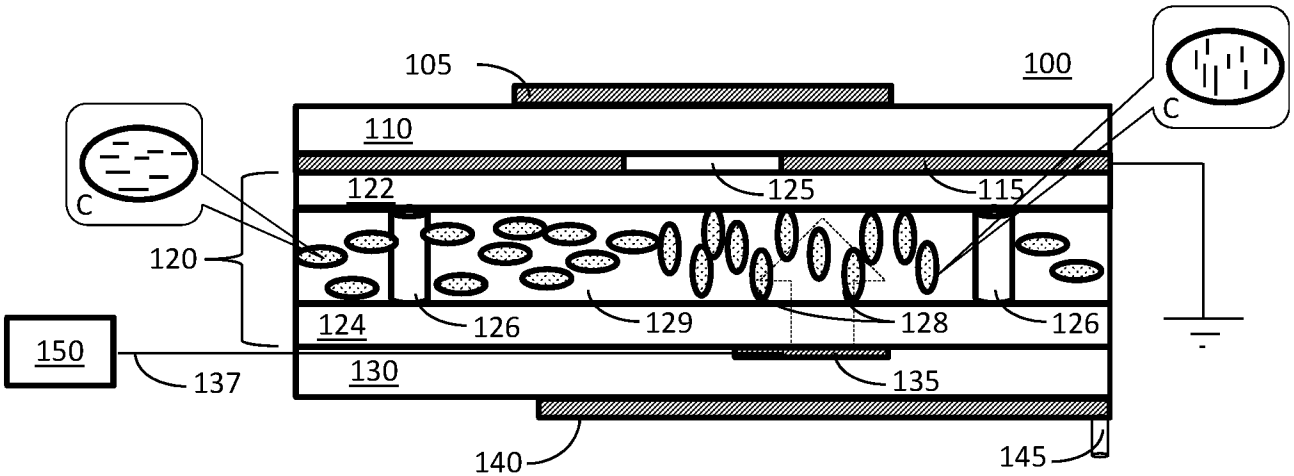
Figure 1C:
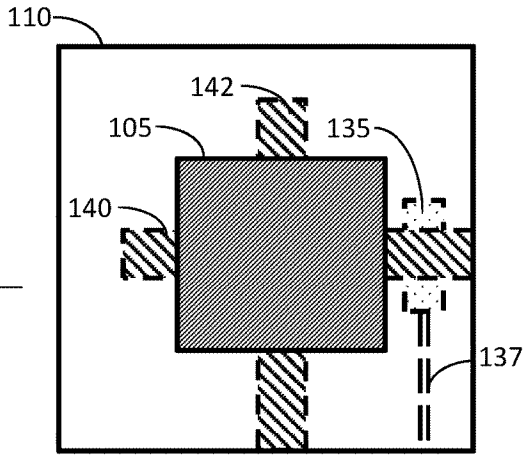
Figure 1B:
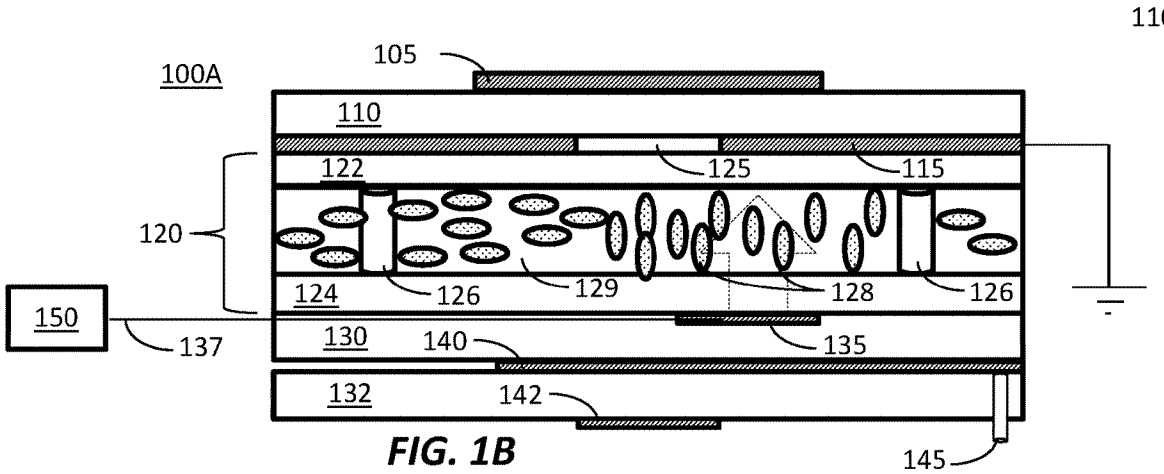
Figure 1E:
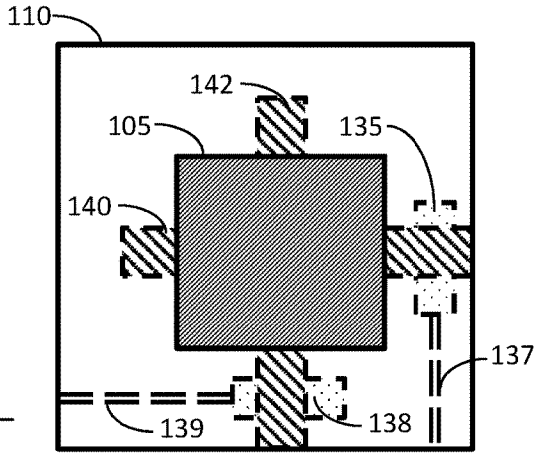
Figure 1D:
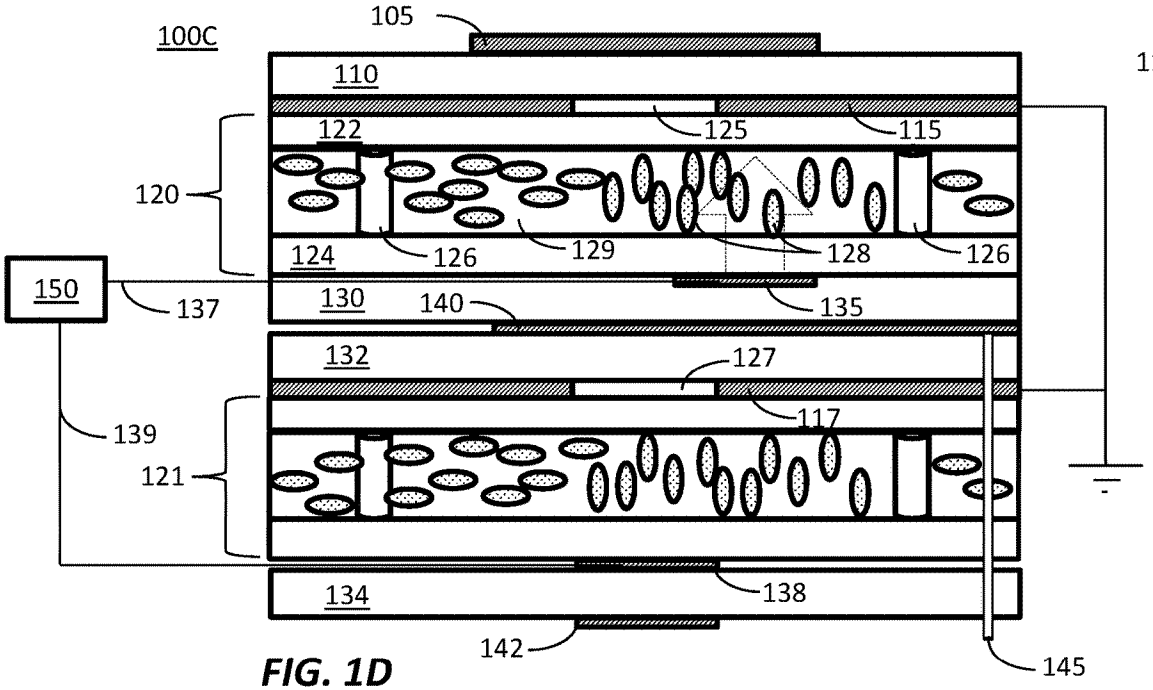
Figure 1F:
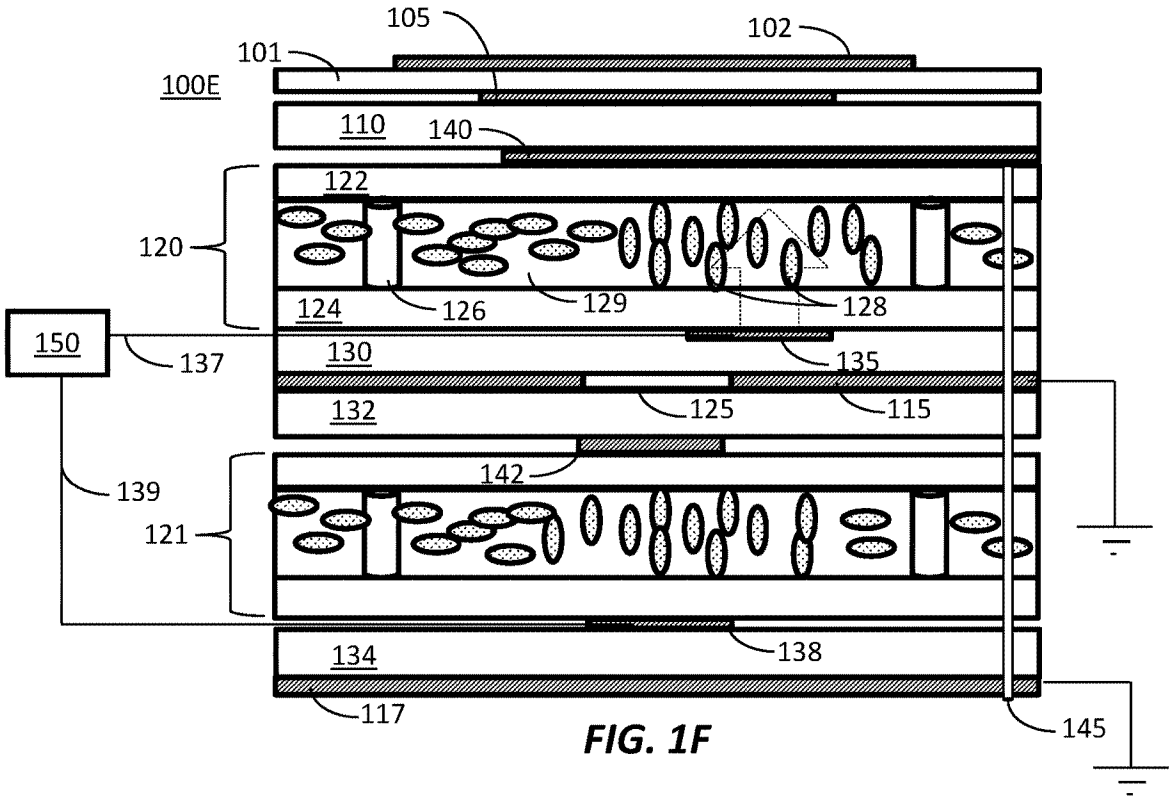
Figure 1G:
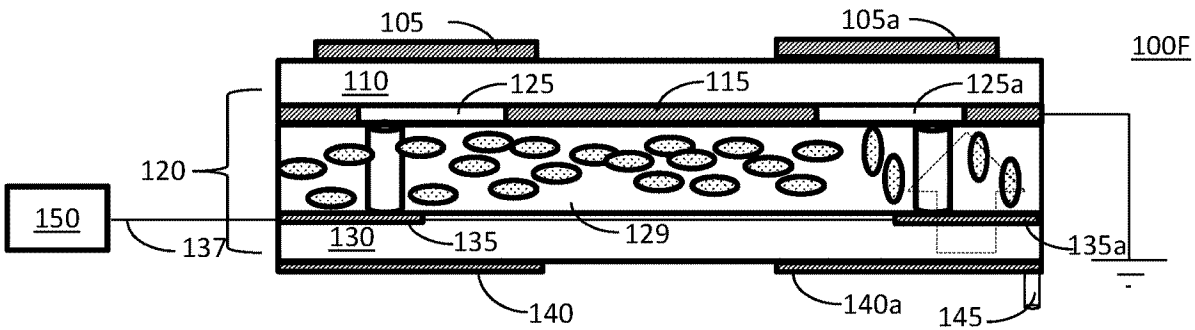
Figure 1H:
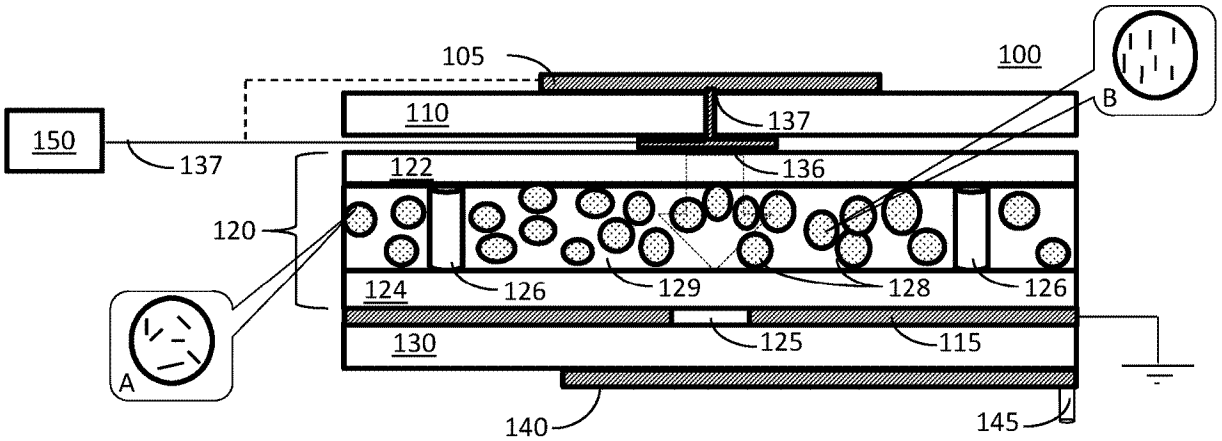
Figure 1J:
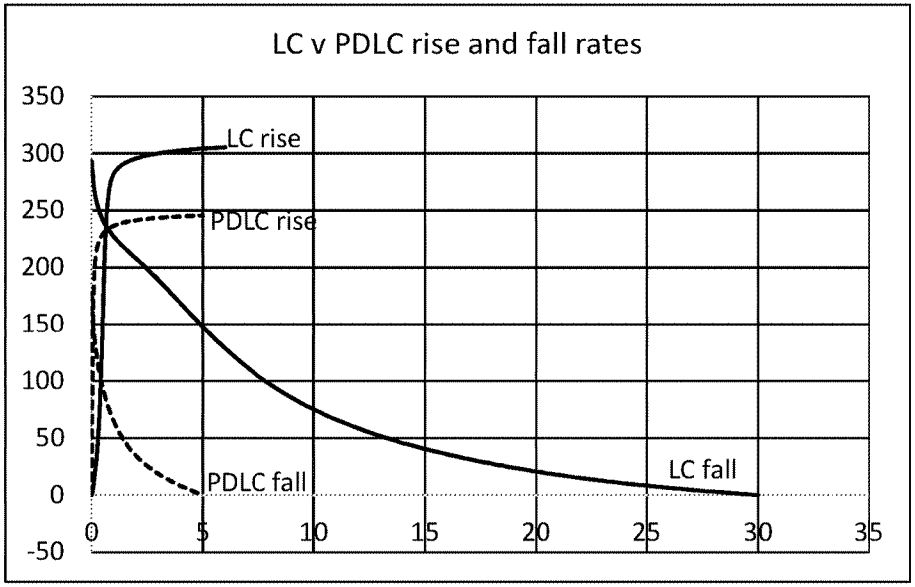
Figure 1I:
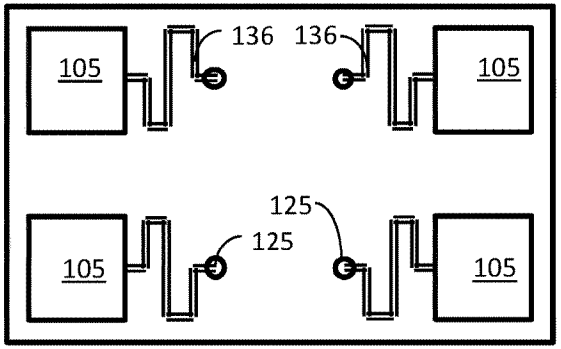
Figure 2:
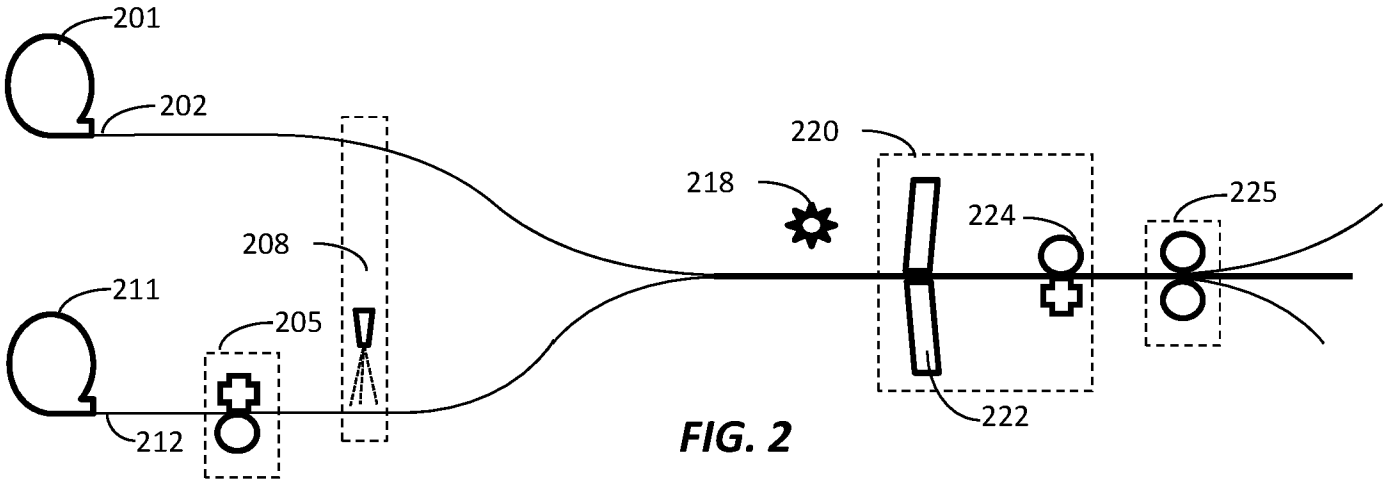

FIG. 1 is a cross-sectional schematic drawing of one embodiment of an antenna using PDLC layer;

FIG. 1A is a cross-sectional schematic drawing of one embodiment of an antenna using SLC layer;

FIG. 1B is a cross-sectional of an embodiment having two signal lines coupled to each radiating patch, which may be implemented as PDLC or SLC, while FIG. 1C is a top view thereof;

FIG. 1D is a cross-sectional of an embodiment having two PDLC/SLC layers and two ground planes, which may be implemented as PDLC or SLC, while FIG. 1E is a top view thereof;

FIG. 1F is a cross-sectional of an embodiment having modified layers order;

FIG. 1G illustrates an embodiment of PDLC layer without dielectric carrier films and also with multiple radiating patches;

FIG. 1H illustrates yet another embodiment, which may be implemented using either PDLC or SLC;

FIG. 1I illustrates a top view for an embodiment of a 2×2 array antenna which utilizes the construction of FIG. 1H;

FIG. 1J illustrates rise and fall rates of a LC layer and a corresponding PDLC layer; and FIG. 2 illustrates a roll-to-roll method of manufacturing the PDLC/SLC layer according to the embodiments of the invention.

DETAILED DESCRIPTION

Embodiments of the inventive RF device will now be described with reference to the drawings. Different embodiments or their combinations may be used for different applications or to achieve different benefits. Depending on the outcome sought to be achieved, different features disclosed herein may be utilized partially or to their fullest, alone or in combination with other features, balancing advantages with requirements and constraints. Therefore, certain benefits will be highlighted with reference to different embodiments, but are not limited to the disclosed embodiments. That is, the features disclosed herein are not limited to the embodiment within which they are described, but may be "mixed and matched" with other features and incorporated in other embodiments As noted above, liquid crystal (LC) layers have been suggested previously for use in RF devices. However, the subject inventors have noted that the while the LC layer provides sufficient performance for optical devices, its response time is rather slow for RF or microwave devices. The subject inventors therefore searched for alternatives to LC and, unexpectedly discovered that layers of PDLC provide faster response time than corresponding LC layers. In FIG. 1J the inventors plotted the data of rise (alignment of domains in response to applied electric field) and fall (the relaxation of the domain in response to removal of the electric field) of a PDLC layer and a corresponding LC layer. The y-axis shows the amount of phase shift in degrees, while the x-axis shown time in seconds. The data of the LC layer is shown in solid line, while the data for the PDLC is shown in dotted line. As shown in Plot 1, both rise and fall times for the PDLC are faster than that of a corresponding LC layer.

The subject inventors also discovered that if the liquid crystal layer of a PDLC is made thick enough, these structures can be used as variable dielectrics to control the operating characteristics of an RF or microwave device and still maintain fast and adequate response time. The actual thickness used depends on the wavelength used with the RF device, and can generally be between 50 to 500 microns. Choosing the right cell thickness is also a function of the tan $\delta$ of the LC in the cell, as increasing the cell thickness increases the entire device losses.

FIG. 1 illustrates a first example of the use of PDLC in an RF/microwave device, in this example an antenna 100. The antenna 100 has a radiating patch 105, generally in the form of a copper patch formed or adhered to dielectric 110. Dielectric 110 may be, e.g., Rogers® circuit board material, glass, PET, Teflon, etc. A ground plane 115 is provided between the bottom of dielectric 110 and the PDLC layer 120. A coupling window 125 is formed in the ground plane and is used to couple RF energy between the radiating patch 105 and the signal line 140. The signal line is coupled to an output port, e.g., a coaxial F-connector. Thus, the RF signal is capacitively coupled between the signal line 140 and radiating patch 105, via the intervening dielectric layer formed by the PDLC layer 120. Note also that the ground plane 115, the PDLC layer 120, and the signal line 140 form a capacitor, the characteristics of which depends on the dielectric constant value of the PDLC layer 120.

The PDLC layer 120 is formed by a top dielectric layer/film 122, a bottom dielectric layer/film 124, spacers 126, and liquid crystal microdomains 128 dispersed in polymer 129 forming a PDLC. In this embodiment, a high LC to polymer ratio is utilized, wherein the LC/polymer includes at least 70%, and preferably at least 80%, LC by weight. Additionally, no alignment film is provided, such that the liquid crystals (directors) inside the microdomains 128 are randomly oriented, as shown in the callout A. Surprisingly, such a structure has faster response time than an LC film having alignment layer.

An electrode 135 is coupled via control line 137 to a controller 150, which applies an AC, a DC, or a square-wave DC potential to the electrode 135. When the controller applies potential to the electrode 135, an electric field (indicated by the broken-line arrow) is formed, which causes the liquid crystals inside each of microdomains 128 in the vicinity of the electrode 135 to rotate in an amount corresponding to the applied potential, as shown in the callout B. Consequently, the characteristics of the capacitor formed between the ground plane 115 and the signal line 140 changes. This can be used to control the RF signal traveling in the signal line 140, e.g., to cause a delay or phase shift in the signal. Of course, since in the relaxed state (no electric field applied) the domains are randomly oriented, the amount of change is lower than with an LC having alignment layer. That is, delta ε ($\Delta\varepsilon=\varepsilon_{|}-\varepsilon\perp$) is lower than what could be reached if the starting, or "off" state was purely aligned perpendicularly, ε⊥. However, the amount is sufficient and is compensated by the superior reaction speed of the PDLC device, especially for microwave devices.

FIG. 1A illustrates a first example of the use of SLC in an RF/microwave device, in this example an antenna 100. The antenna 100 has a radiating patch 105, generally in the form of a copper patch formed or adhered to dielectric 110. Dielectric 110 may be, e.g., Rogers® circuit board material, glass, PET, Teflon, etc. A ground plane 115 is provided between the bottom of dielectric 110 and the PDLC layer 120. A coupling window 125 is formed in the ground plane and is used to couple RF energy between the radiating patch 105 and the signal line 140. The signal line is coupled to an output port, e.g., a coaxial F-connector. Thus, RF signal is capacitively coupled between the signal line 140 and radiating patch 105, via the intervening dielectric layer formed by the SLC layer 120. Note also that the ground plane 115, the SLC layer 120, and the signal line 140 form a capacitor, the characteristics of which depends on the dielectric constant value of the SLC layer 120.

The SLC layer 120 is formed by a top dielectric layer/film 122, a bottom dielectric layer/film 124, spacers 126, and liquid crystal microdomains 128 dispersed in polymer 129 forming a PDLC. In this embodiment, a high LC to polymer ratio is utilized, wherein the LC/polymer includes at least 70%, and preferably at least 80%, LC by weight. Additionally, while no alignment film is provided, the liquid crystals inside the liquid crystal microdomains 128 are aligned by use of shearing. Specifically, by applying a shearing force between the top and bottom films 122 and 124, the microdomains 128 elongates as illustrated in FIG. 1A. Additionally, due to the shearing force the LC domains within the liquid crystal microdomains 128 are all aligned in the direction of the shear force, as shown in the callout C.

An electrode 135 is coupled via control line 137 to a controller 150, which applies an AC, a DC, or a square-wave DC potential to the electrode 135. When the controller applies potential to the electrode 135, an electric field (indicated by the broken-line arrow) is formed, which causes the liquid crystal domains inside each of microdomains 128 in the vicinity of the electrode 135 to rotate in an amount corresponding to the applied potential, as shown in the callout D. In FIG. 1A the microdomains are illustrated as rotated in order to convey the concept that the LC domains inside each liquid crystal microdomains 128 are rotated, but in reality the microdomains do not rotate, only the LC inside the microdomains 128 rotate. Consequently, the characteristics of the capacitor formed between the ground plane 115 and the signal line 140 changes. This can be used to control the RF signal traveling in the signal line 140, e.g., to cause a delay or phase shift in the signal. Of course, in this embodiment, since in the relaxed state (no electric field applied) the domains are aligned in the perpendicular direction, the amount of change is higher than with randomly oriented PDLC. That is, delta ε ($\Delta\varepsilon=\varepsilon_{|}-\varepsilon\perp$) is high since in the starting, or "off" state, the domains are purely aligned perpendicularly, ε⊥.

In FIG. 1 the liquid crystal microdomains 128 are shown generally as spheres and the domains within these spheres are randomly oriented. In FIG. 1A the liquid crystal microdomains 128 are illustrated as ovals—to indicate the stretching due to the shearing force. To illustrate the LC domain rotation in the shear aligned liquid crystal microdomains 128, the ovals are shown rotated. The following embodiments disclosed below can be implemented using either PDLC or SLC. Therefore, as a shortcut the layer will be referred to as PDLC/SLC, and the oval drawing will be used. Thus, in essence, each Figure illustrates two possible embodiments, one using PDLC and one using SLC.

In the examples of FIGS. 1 and 1A, only one radiating patch and one signal line are shown, but this arrangement can be repeated in a two-dimensional array to thereby form an electronically steerable antenna. In such an arrangement, multiple control lines can be provided, one for each of the signal lines. Also, the ground plane would have multiple coupling windows, one corresponding to each signal line and its corresponding radiating patch.

Thus, according to one embodiment, an antenna is provided, comprising: a dielectric plate; at least one radiating patch provided on the dielectric plate; a ground plane having at least one window, wherein each radiating patch is aligned with one window; at least one signal line, wherein each signal line is configured for capacitively coupling RF signal to one radiating patch; and a polymer dispersed liquid crystal (PDLC) layer provided between the signal line and the ground plane and comprising a top dielectric film, a bottom dielectric film, a plurality of spacers provided between the top dielectric film and bottom dielectric film, a polymer layer provided between the top dielectric film and the bottom dielectric film, and a plurality of liquid crystal microdomains dispersed in the polymer layer. The spacers may be made of, e.g., glass, PS (polystyrene), PE (polyethylene), PP (polypropylene), PMMA, Silica, Cellulose acetate, Zirconia, acrylic or epoxy, etc. Also, the polymer layer may be shear-stressed, thus forming an SLC layer.

FIGS. 1 and 1A illustrate examples wherein each patch has one signal line coupled to it. On the other hand, FIGS. 1B and 1C illustrate an embodiment wherein each radiating patch has two signal line coupled to it, wherein the two signal lines are orthogonal to each other. The elements of the embodiment of FIGS. 1B and 1C are the same as in the embodiments of FIG. 1 or 1A, except that another dielectric layer 132 is provided below the first signal line 140, and an orthogonal second signal line 142 is provided below the second dielectric layer 132. In this embodiment, one signal line can be used for transmission while the other signal line can be used for reception. In another implementation both signal lines can be used to generate a circularly polarized signal by applying the control signal to electrode 135 in a manner that delays the signal in one of the signal lines with respect to the other. Of course, as with the embodiments of FIGS. 1 and 1A, the embodiment of FIGS. 1B and 1C can be implemented using a plurality of radiating patches and corresponding signal and control lines.

FIGS. 1D and 1E illustrate an embodiment wherein the transmission characteristics of each signal lines 135, 142, can be controlled independently. Notably, this embodiment utilizes multiple ground planes, each having windows aligned to couple RF signal between the radiating patch and the corresponding signal line. The arrangement can be implemented with multiple radiating patches, just as with the other embodiments. When implemented as a two-dimensional array, the beam can be steered in any direction in hemisphere space by the control signals applied to the multiple control lines, so as to independently control the delay applied to each signal line.

As illustrated in FIG. 1D, the signal propagating in signal line 140 is controlled by applying control signal to electrode 135, thus rotating the LC microdomains in PDLC/SLC later 120, and the signal propagating in signal line 142 is controlled by applying control signal to electrode 138, thus rotating the LC microdomains in PDLC/SLC later 121. Thus, in one example the signals are delayed by 90° with respect to each other, so as to generate circular polarization.

Thus, the embodiment of FIGS. 1D and 1E provide an antenna having multiple PDLC/SLC layers and multiple ground planes, comprising: a top dielectric layer; a plurality of radiating patches provided over the top dielectric layer; a first liquid crystal layer positioned below the top dielectric layer; a first ground plane having a plurality of windows, each window aligned with one of the radiating patches; a plurality of first signal lines each terminating in alignment with one of the radiating patches; a plurality of first control lines, each aligned with one of the first signal lines; a second liquid crystal layer; a second ground plane having a plurality of windows, each aligned with one of the radiating patches; a plurality of second signal lines each terminating in alignment with one of the radiating patches; and a plurality of second control lines, each aligned with one of the first signal lines; wherein each of the first and second liquid crystal layers comprises a top dielectric, a bottom dielectric, a plurality of spacers provided between the top dielectric and bottom dielectric, a polymer layer provided between the dielectric and bottom dielectric, and a plurality of liquid crystal microdomains dispersed in the polymer layer. The polymer layer may be a shear-stressed polymer layer.

In the embodiment illustrated, the layers are arranged in the order, top to bottom: radiating patches, top dielectric layer, first ground plane, first (optionally stressed) liquid crystal layer, first control lines, first signal lines, second ground plane, second (optionally stressed) liquid crystal layer, second control lines and second signal lines. Also, as illustrated, various intermediate dielectric layers are provided between the various signal lines, control lines and ground planes. It should be noted, however, that the illustrated order of layers is not mandatory and other orders can be utilized. For example, FIG. 1F illustrates an embodiment having multiple PDLC/SLC layers and multiple ground planes, but in a different order than that of FIG. 1D.

FIG. 1F illustrates an embodiment similar to that of FIG. 1D, except that the order of layers is different. In FIG. 1F, the first signal line 140 is provided below the radiating patch 105, but above the first ground plane 115 and above the first PDLC/SLC layer 120. The first control line 135 may be provided above or below the first PDLC/SLC layer 120. The first ground plane 115 is provided below the first PDLC/SLC layer 120. While in this embodiment the first ground plane 115 has window 125, the window 125 is for coupling the signals to the second signal line 142 and is therefore aligned for the second signal line 142, not the first signal line 140. The signal for the first signal line 140 is coupled directly to the radiating patch 105 through the top dielectric 110.

As indicated, the window 125 in the first ground plane is aligned to couple the RF signal from the second signal line 142, since the second signal line 142 is below the first ground plane, but is above the second PDLC/SLC layer 121. The second ground plane 117 is provided below the second signal line 142 and, therefore, requires no windows. The second control line 138 may be provided below or above the second PDLC/SLC layer 121.

Therefore, an RF antenna having multiple ground planes and multiple variable dielectric layers is provided, comprising: a top dielectric layer; a plurality of radiating patches provided over the top dielectric; a first variable dielectric constant (VDC) layer; a first ground plane having a plurality of windows, each aligned with one of the radiating patches; a plurality of first signal lines, each terminating below one of the windows of the first ground plane; a plurality of first control lines, each configured to control liquid crystal domains of the first VDC layer in vicinity of one of the first signal lines; a second VDC layer provided below the first VDC layer; a second ground plane having a plurality of windows, each aligned with one of the radiating patches; a plurality of second signal lines, each terminating below one of the windows of the second ground plane; and a plurality of second control lines, each configured to control liquid crystal domains of the second VDC layer in vicinity of one of the second signal lines.

In fabricating the PDLC/SLC for the RF devices, the two opposing dielectric substrates which encapsulate the liquid crystal cell (PDLC or SLC) can be made of any non-conduction material desired, whether transparent or opaque, since there are no optical considerations. The control electrodes can be made by, e.g., deposition such as evaporation, electroplating, electroless plating, etc., may be printed on using conducting ink or paste, etc. As shown in the embodiments disclosed herein, the control electrodes may be positioned on either side of the liquid crystal cell to generate the electrical field as required for the function of the RF device. The control electrode and signal line materials can be a type of conduction material, specifically metal, such as gold (Au), silver (Ag), Titanium (Ti), Copper (Cu), Platinum (Pt), or other metals and/or metals layering or alloying. In between the two substrates, spacers made of insulating material are placed to fix and maintain the desired cell gap.

Following cell assembly, the liquid crystal and polymer precursors are mixed, with weight ration of LC above 70%, and the cell is filled with the liquid mixture. Phase separation of the liquid crystal, into a non-cured (liquid phase) liquid crystal domains, and cured polymer (solid phase) is achieved via multiple possible ways, such as polymerization induced phase separation (PIPS), solvent-induced phase separation (SIPS), non-solvent induced phase separation (NIPS), thermally induced phase separation (TIPS), emulsion-based PDLC, and other methods as known on the art. The resulting structure is the PDLC layer. In the PDLC, the liquid crystal domains are usually spherical or amorphous shape, and in these liquid crystal domains the liquid crystal directors themselves are oriented freely and without any general direction. Such PDLC film can be used in the disclosed embodiments.

To obtain an SLC film, a shearing action is applied to the top or bottom substrates of the PDLC (any opposing movement of the top and bottom surfaces will generate such a shearing effect on the PDLC). The shearing may be done during or after the phase separation process. After shearing, the SLC contains elongated liquid crystal domains, in the shearing direction. The film is now referred to a Stressed Liquid Crystal (SLC), and in the liquid crystal elongated domains themselves the liquid crystal directors are pointing in the same direction—the shearing direction. As it follows, the liquid crystal is thereby aligned throughout the bulk of the SLC, disregarding the SLC thickness and length. Unlike liquid crystal cells, like in an LCD screen, in this SLC media there is no need for an alignment layer on the substrates. Furthermore, the cell gap or height can be much higher than an LCD liquid crystal cell but still maintain LC domain alignment. When an electrical field is applied (usually between the two opposing electrodes), the liquid crystal directors rotate parallel to the electrical field direction and by doing so change their dielectric constant.

The phase separation stage is a critical parameter influencing the device ultimate performance. Initially, choosing the right polymer/pre-polymer and liquid crystal (or mixture thereof) must be so that there is as little as possible liquid crystal dissolved in the polymer, and that upon phase separation the highest degree of phase separation is achievable.

Initially, the pre-polymer and LC mixture are heated to a temperature higher than the LC intrinsic temperature, so that the phase separation occurs when the LC is in its liquid form. Following the phase separation stage, the cell's temperature is reduced to Tn, and phase separation is continued until the entire pre-polymer is polymerized, and with as little as possible LC dissolved in the polymer matrix. In order to achieve a high degree of LC director's alignment in the LC domains, it is preferable to have the LC domains as small as possible, while still allowing LC molecules movement and spin ability. Later, when the polymer is sheared (or stretched in one or two directions), the LC directors will be strongly aligned in the shearing direction, which is parallel to the cell's top and bottom substrates (or carrier films).

The PDLC and/or SLC layers can be produced by roll to roll methods or using pre-cut thin polymer sheets. By maintaining the gap between the two enclosing carrier films, and polymerizing the three-layered film, a PDLC is formed in the same phase separation methods as described before. The PDLC can then be used in any of the disclosed embodiments. If the polymer used is not polymerized completely, or if it is thermoplastic in nature, a second stage of shearing or stretching (one or two directions) will produce the SLC layer, held between the two polymer films. Following that, the 3-layer polymer (two enclosing polymer films and the SLC in between) can be placed inside an RF device, without the need to conduct the entire chemical and mechanical process inside the RF device. In such a way, production will be greatly simplified. Another option is to use the roll-to-roll technology, the fabrication system can be adjusted such that one of the substrates is moving faster than the other, whereby shearing is carried out and the final polymerized three layered films comes out—sheared and aligned.

FIG. 2 illustrates a roll-to-roll method of manufacturing the PDLC/SLC layer according to the embodiments of the invention. In FIG. 2, supply roll 201 provides a continuous strip of flexible insulating material 202, e.g., PET, polymer nanocomposites, Pyralux® (Available from Du Pont), ECCOSTOCK® low loss dielectrics (Available from Emerson & Cuming of Laird PLC, London, England), etc. Meanwhile, supply roll 211 provides a continuous strip of insulating material 112, made of same or similar material as strip 202. The insulating strip 212 is passed through spacer station 205, wherein spacers are formed or deposited on the top surface of the insulating strip 212.

In PDLC station 208 the mixture of polymer precursor and liquid crystal microdomains is deposited onto the strip 202. The top and bottom films are then brought together and enter polymerization station 218 for phase separation and curing. Polymerization station 218 may operate according to any of the principles already mentioned, such as, PIPS, SIPS, NIPS, etc. Several options are available after the polymerization station 218. For example, the film now may be cut to size and each cut piece may be used to form an RF or microwave device, as disclosed herein. If an SLC is desired, then the cut piece may be transferred to a shearing station to impart the shear force to each cut piece individually.

Alternatively, the shear force can be imparted prior to cutting the film by shear station 220. For example, the supply of film can be halted, e.g., using clamps or vise 222, while one of the top or bottom films is still being pulled, e.g., by roller 224, thus creating relative shearing motion between the top and bottom films.

After shearing station 220 the film may be cut to size. Alternatively, as shown in FIG. 2, peeling station 225 is used to peel away the top or bottom, or both films, so as to draw a sheared and polymerized PDLC/SLC layer, which can then be cut to size. The layer than contains only a fully polymerized film, which is composed of the LC and surrounding polymer matrix only. By achieving this, the overall dielectric constant of the active layer is closer to the LC's dielectric constant and the delta of dielectric constants is maintained higher, generating higher electronic performance for the RF device. The same process can be performed on the PDLC film.

FIG. 1G illustrates an embodiment wherein the top and bottom carrier films are removed from the PDLC after the curing and shearing. In general, the embodiment of FIG. 1G is similar to that of FIG. 1, except that carrier dielectric films 122 and 124 are not used. In this embodiment, after the preparation of the PDLC/SLC layer is completed, the carrier dielectric films are removed and the neighboring metal layers directly contact the polymerized material 129. In this particular embodiment, metal layers ground plane 115 and the control lines 135 are in direct physical contact with the polymerized material 129. For example, the ground plane 115 and/or the control lines 135 may be formed directly on or adhered to the polymerized material 129. The same implementation can be done in any of the other embodiments disclosed herein.

Another feature illustrated in FIG. 1G that may be implemented using any of the other embodiments disclosed herein is having multiple radiating patches, although only two 105 and 105*a* are shown in FIG. 1G. In this embodiment, the signal of each radiating patch is fed independently using signal lines 140 and 140*a*, via corresponding windows 125 and 125*a*. Also, the dielectric constant for each signal line is controlled independently by corresponding control lines 135 and 135*a*. Thus, when the multiple radiating patches are provided in an array, the dielectric for each signal line can be controlled independently, thereby introducing different delay to each line, thus steering or scanning the beam.

FIG. 1H illustrates yet another embodiment, which may be implemented using either PDLC or SLC. The arrangement of FIG. 1H differs from the embodiment of FIG. 1, in that a meandering delay line 136 is connected to the radiating patch 105 using a contact via 137. The delay line ohmically couples the RF/microwave signal to the radiating patch through the contact via 137. The signal is then capacitively coupled to the signal line through the window 125 is ground plane 115. The PDLC or SLC layer is provided between the meandering delay line and the ground plane. FIG. 1I illustrates a top view of a 2×2 array antenna which utilizes the construction of FIG. 1H, which better illustrates the meandering delay line 136 and the location of the window 125 in the ground plane.

In FIG. 1H the control signal is applied to the meandering delay lines, so as to control the orientation of the liquid crystals below the delay line. Conversely, as shown in broken line, the control signal may be applied to the radiating patch 105. In this case, since the radiating patch is ohmically connected to the delay line through the contact via, the control signal is distributed to the delay line as well.

Thus, an antenna is provided, comprising: a top dielectric plate; a plurality of radiating patches provided over the dielectric plate; a plurality of meandering delay lines provided below the dielectric plate; a plurality of contact via, each connecting one of the meandering delay line to one of the radiating patches; a VDC layer provided below the plurality of meandering delay lines; a ground plane provide below the VDC layer and having a plurality of windows, each window aligned below one of the delay lines; and a plurality of signal lines, each aligned below on of the windows; wherein the VDC plate comprises one of a PDLC or an SLC.

It should be understood that processes and techniques described herein are not inherently related to any particular apparatus and may be implemented by any suitable combination of components. Further, various types of general purpose devices may be used in accordance with the teachings described herein. The present invention has been described in relation to particular examples, which are intended in all respects to be illustrative rather than restrictive. Those skilled in the art will appreciate that many different combinations will be suitable for practicing the present invention.

Moreover, other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

The invention claimed is:

1. An antenna comprising:

a variable dielectric constant (VDC) layer;

a plurality of radiating patches provided over the VDC layer;

a plurality of signal lines, each terminating in alignment below one of the radiating patches;

a plurality of control lines, each corresponding to one of the signal lines;

a ground plane;

wherein the VDC layer comprises a polymer dispersed liquid crystal (PDLC) layer; and wherein:

the VDC layer further comprises a top dielectric film and a bottom dielectric films, spacers distributed between the top dielectric film and bottom dielectric film, and wherein the PDLC is dispersed among the spacers;

the signal line is provided above the top dielectric film and, the control line is provided below the bottom dielectric film.

2. The antenna of claim 1, wherein the PDLC layer is in a polymerized and sheared state.

3. The antenna of claim 1, wherein the ground plane comprises a plurality of windows, each window aligned in a direct line of sight between one of the radiating patches and a corresponding one of the signal lines.

4. The antenna of claim 1, wherein the ground plane is provided below the bottom dielectric plane.

5. The antenna of claim 1, further comprising a controller applying a square-wave DC potential to the plurality of control lines.

6. The antenna of claim 1, further comprising a plurality of meandering delay lines, each connected to one of the radiating patches by a contact via.

7. An antenna comprising:

a variable dielectric constant (VDC) layer comprising a polymer dispersed liquid crystal (PDLC) layer;

a plurality of radiating patches provided over the VDC layer;

a plurality of signal lines, each terminating in alignment below one of the radiating patches;

a plurality of control lines, each corresponding to one of the signal lines;

a ground plane;

a plurality of orthogonal signal lines each terminating in alignment below one of the radiating patches and at an orthogonal direction to one of the plurality of signal lines; and, further comprising a second VDC layer positioned between the plurality of signal lines and plurality of orthogonal signal lines.

8. The antenna of claim 7, wherein the VDC layer further comprises a top dielectric film and a bottom dielectric films, spacers distributed between the top dielectric film and bottom dielectric film, and wherein the PDLC is dispersed among the spacers.

9. The antenna of claim 7, wherein the VDC layer further comprises a top film, a bottom film, and a plurality of spacers between the top film and the bottom film, and wherein the PDLC is dispersed among the spacers.

10. The antenna of claim 7, wherein the ground plane comprises a plurality of windows, each window aligned in a direct line of sight between one of the radiating patches and a corresponding one of the signal lines, and each signal line is configured for capacitively coupling RF signal to one radiating patch through one of the plurality of windows.

11. An antenna comprising:

a variable dielectric constant (VDC) layer;

a plurality of radiating patches provided over the VDC layer;

a plurality of signal lines, each terminating in alignment below one of the radiating patches;

a plurality of control lines, each corresponding to one of the signal lines;

a ground plane;

a plurality of meandering delay lines, each connected to one of the radiating patches by a contact via;

wherein the VDC layer comprises a polymer dispersed liquid crystal (PDLC) layer and the PDLC layer is provided between the meandering delay lines and the ground plane, and wherein RF signal is ohmically coupled between each radiating patch to one of the meandering delay lines and is then capacitively coupled to one of the signal lines via a window in the ground plane.

12. The antenna of claim 11, wherein: the VDC layer further comprises a top dielectric film and a bottom dielectric films, spacers distributed between the top dielectric film and bottom dielectric film, and wherein the PDLC is dispersed among the spacers; the signal line is provided above the top dielectric film; and the control line is provided below the bottom dielectric film.

13. The antenna of claim 11, further comprising a plurality of orthogonal signal lines each terminating in alignment below one of the radiating patches and at an orthogonal direction to one of the plurality of signal lines.

14. The antenna of claim 13, further comprising a second ground plane.

15. The antenna of claim 14, wherein the second ground plane comprises a plurality of windows, each aligned in a direct line of sight between one of the radiating patches and a corresponding one of the orthogonal signal lines.

16. The antenna of claim 13, further comprising a plurality of second control lines, each corresponding to one of the orthogonal signal lines.

17. The antenna of claim 11, wherein the PDLC layer comprises liquid crystal microdomains dispersed in the polymer layer.

18. The antenna of claim 17, wherein the polymer layer comprises a shear-stressed polymer layer and the liquid crystal microdomains comprise shear aligned domains.

19. The antenna of claim 17, wherein an amount of liquid crystal microdomains in the PDLC layer is at least 80% by weight.

20. The antenna of claim 11, further comprising a controller applying a square-wave DC potential to the plurality of control lines.

* * * * *